US007744272B2

(12) United States Patent
Hozumi et al.

(10) Patent No.: US 7,744,272 B2
(45) Date of Patent: Jun. 29, 2010

(54) PORTABLE APPARATUS AND PORTABLE TIMEPIECE HAVING A PUSH BUTTON

(75) Inventors: Yoshio Hozumi, Chiba (JP); Kazutaka Imai, Chiba (JP)

(73) Assignee: Seiko Instruments Inc. (JP)

( * ) Notice: Subject to any disclaimer, the term of this patent is extended or adjusted under 35 U.S.C. 154(b) by 19 days.

(21) Appl. No.: 12/221,050

(22) Filed: Jul. 30, 2008

(65) Prior Publication Data

US 2009/0040881 A1 Feb. 12, 2009

(30) Foreign Application Priority Data

Aug. 10, 2007 (JP) ..... 2007-209105

(51) Int. Cl.
*G04B 37/10* (2006.01)

(52) U.S. Cl. ..... 368/290; 200/302.2; 368/308

(58) Field of Classification Search ..... 368/289, 368/290, 308, 319, 320, 321; 200/302.2
See application file for complete search history.

(56) References Cited

U.S. PATENT DOCUMENTS

| | | | | |
|---|---|---|---|---|
| 5,663,934 | A * | 9/1997 | Wenger et al. | 368/290 |
| 5,751,668 | A * | 5/1998 | Eray | 368/290 |
| 6,872,899 | B2 * | 3/2005 | Oshio et al. | 200/43.13 |
| 2007/0074545 | A1 * | 4/2007 | Hiranuma et al. | 70/25 |

* cited by examiner

*Primary Examiner*—Truc T Nguyen
*Assistant Examiner*—Jason Collins
(74) *Attorney, Agent, or Firm*—Adams & Wilks

(57) ABSTRACT

A portable apparatus has a push button mounted on a casing for operating a contact inside the casing. The push button is axially slidable in a pipe fixed in a through-hole extending through the casing. A coil spring encircles the pipe and is interposed between a flange of the pipe and a head of the push button to urge the push button outwardly. A packing ring for sealing the space between the pipe and push button is attached to either the pipe or the push button in the region where the coil spring encircles the pipe. Since the coil spring overlaps the packing ring, the axial length of the pipe and push button can be shortened to reduce the size of the casing.

20 Claims, 3 Drawing Sheets

PORTABLE APPARATUS AND PORTABLE TIMEPIECE HAVING A PUSH BUTTON

BACKGROUND OF THE INVENTION

1. Field of the Invention

The present invention relates to a portable apparatus and a portable timepiece having a push button.

2. Related Art

There is known a portable timepiece such as a wristwatch, a pocket watch or the like, a stopwatch, or a portable apparatus of a portable telephone, a portable type information terminal or the like, which has a push button for operating, for example, a contact or the like inside of an apparatus case. By pushing the push button by a predetermined stroke, for example, in a portable timepiece, a time display is switched from an analog display to a digital display or conversely thereto, or date or day of week displayed in digital form is corrected.

A portable apparatus of this kind includes a coil spring for urging the push button in a direction of pushing back the push button. Along therewith, a portable apparatus includes a ring-like packing for achieving waterproof at a portion at which the push button is installed by inserting the apparatus case.

Specifically, a pipe is inserted and attached in a through hole provided at a bottom wall of a recess portion of a surface of the apparatus case. A shaft portion of the push button is inserted to the pipe, and an outer periphery of the shaft portion is mounted with a packing for waterproof. The coil spring is interposed by a back face of an operating portion of the push button and the bottom wall of the recess portion, opposed thereto, and the shaft portion of the push button is passed to an inner portion of the spring. Therefore, the coil spring and the packing are provided to be aligned along an axial direction of the shaft portion of the push button (refer to, for example, Patent Reference 1).

[Patent Reference 1] JP-A-2000-230989 (paragraphs 0002-0006, paragraphs 0025-0038, FIG. 1-FIG. 3)

According to an arrangement of aligning the coil spring and the packing along the axial direction of the shaft portion of the push button as in the technology of Patent Reference 1, the shaft portion of the push button is provided with a shaft portion region for attaching the packing at a position which is shifted in the axial direction relative to a shaft portion region in correspondence with a height of the coil spring, and therefore, a total length of the push button is long.

Therefore, for example, when the push button is to be projected from an outer side face of a case body of the portable timepiece, the projected width is prolonged. In order to restrict the projected width of the push button to a predetermined length, the case body needs to be enlarged. However, thereby, the portable timepiece becomes large and heavy, and there is provided a design in which a thickness of a front face of the case body is large in the region around a cover glass for seeing therethrough a time display portion, which is not preferable.

It is an object of the invention to provide a portable apparatus and a portable timepiece capable of shortening a length in an axial direction of a push button.

SUMMARY OF THE INVENTION

In order to resolve the problem, a portable apparatus of the invention includes an apparatus exterior having a through hole, a pipe formed by providing an outwardly arranged cylinder portion having a spring receiving face integrally with an inserting cylinder portion, and fixed to the apparatus exterior by inserting the inserting cylinder portion to the through hole and arranging the outwardly arranged cylinder portion to an outer portion of the apparatus exterior, a push button including a shaft portion movably penetrating the pipe, a drawout preventing member attached to one end portion disposed in the apparatus exterior of the shaft portion for preventing the shaft portion from being drawn out from the pipe, and an operating head provided at other end of the shaft portion disposed at outside of the apparatus exterior, a coil spring interposed between the operating head and the spring receiving face for urging the push button to an outer side of the apparatus exterior, and a ring-like packing attached to either of the pipe and the push button within a range of a height of the coil spring and attached concentrically with the coil spring for sealing an interval between the pipe and the push button.

The portable apparatus of the invention is applicable to a portable timepiece of a wristwatch, a pocket watch or the like, a stopwatch, a portable telephone, a portable type information terminal or the like and the apparatus exterior indicates an exterior case or the like. In this disclosure "the coil spring urges the push button to the outer side of the apparatus exterior" and words of like import mean that when the push button is pushed from the front face of the apparatus exterior, the push button is urged to an upper side by the coil spring, and means that when the push button is pushed from the side face of the apparatus exterior, the push button is urged to the outer side by the coil spring.

In this disclosure "the height of the coil spring" means a length from one end to other end of the spring. Along therewith, in this disclosure, "the packing is attached within the range of the height of the coil spring" means that preferably, the packing is arranged in correspondence with an interval from one end of the coil spring supported by the spring receiving face to other end of the coil spring supported by the operating head. However, the constitution includes also an arrangement in a dimensional error range, that is, a case in which although most of the coil spring is arranged in correspondence with the interval from the one end to the other end of the coil spring, a portion of the coil spring passes the spring receiving face to arrange an imaginary line orthogonal to the shaft portion of the push button to exceed to a side of the drawout preventing member of the push button. In this disclosure, "concentrically attached" means an arrangement in which a center of the coil spring and the center of the packing coincide with each other when the push button is viewed in the axial direction.

According to the invention, the ring-like packing for sealing the interval between the pipe and the push button is not arranged by aligning with the coil spring along the axial direction of the shaft portion of the push button but arranged within the range of the height of the coil spring and concentrically with the coil spring.

Thereby, it is not necessary to ensure a region for attaching the packing at the shaft portion of the push button at a position shifted in the axial direction from the shaft portion region in correspondence with the height of the coil spring, and therefore, the length in the axial direction of the push button can be shortened in correspondence with the width dimension of the packing.

According to a preferable mode of the portable apparatus of the invention, the outwardly arranged cylinder portion includes a cylinder end portion extending outwardly from the spring receiving face and opposed to a portion of the coil spring on a side of the spring receiving face, and the packing is attached to the cylinder end portion.

According to this mode of the invention, the packing is attached to push the cylinder end portion to be directed to the end of the coil spring supported by the operating head, and therefore, the packing can be arranged concentrically with the coil spring in correspondence with the interval from the one end to the other end of the coil spring.

According to a preferable mode of the portable apparatus of the invention, the outwardly arranged cylinder portion includes a cylinder end portion extending outwardly from the spring receiving face and inserted between the coil spring and the shaft portion, and the packing is brought into contact with an inner periphery of the cylinder end portion to be attached to the shaft portion.

According to this mode of the invention, the packing attached to the shaft portion of the push button is brought into contact with the cylinder end portion to be directed to the end of the coil spring supported by the operating head, and therefore, the packing can be arranged concentrically with the coil spring in correspondence with the interval from the one end to the other end of the coil spring.

In order to resolve the aforementioned problem, a portable timepiece of the invention is formed using the portable apparatus of the invention of any.

The portable timepiece of the invention is formed using the portable apparatus of the invention, and therefore, a portable timepiece capable of shortening the length in the axial direction of the push button can be provided.

In order to resolve the aforementioned problem, a portable timepiece of the invention includes a timepiece exterior assembly including a case body having a recess portion opened to a case body outer face and provided with a through hole at an innermost wall of the recess portion, a pipe formed by providing an outwardly arranged cylinder portion having a spring receiving face integrally with an inserting cylinder portion, and fixed to the case body by movably inserting the inserting cylinder portion to the through hole and arranging the outwardly arranged cylinder portion at an outer portion of the case body, a push button having a shaft portion penetrating the pipe, a drawout preventing member attached to one end portion of the shaft portion disposed in the case body of the shaft portion for preventing the shaft portion from being drawn out from the pipe, and an operating head provided at other end of the shaft portion disposed at outside of the case body, a coil spring interposed between the operating head and the spring receiving face for urging the push button to an outer side of the case body and forming a gap enabling to push the push button between the innermost wall and the operating head, and a ring-like packing attached to either of the pipe and the push button within a range of a height of the coil spring and concentrically attached to the coil spring for sealing an interval between the pipe and the push button.

According to the portable timepiece of the invention, the ring-like packing for sealing the interval between the pipe and the push button is not arranged by aligning with the coil spring along the axial direction of the shaft portion of the push button but arranged within the range of the height of the coil spring and concentrically with the coil spring.

Thereby, it is not necessary to ensure a region for attaching the packing at the shaft portion of the push button at the position of being shifted from the shaft portion region in correspondence with the height of the coil spring in the axial direction, and therefore, the length in the axial direction of the push button can be shortened in correspondence with the width dimension of the packing. In other words, a projected width of the push button projected from a case body outer face in a side direction can be shortened.

According to a preferable mode of the portable timepiece of the invention, a thickness of from a case body inner face to the case body outer face of the case body is defined by a depth of the recess portion and a thickness of the innermost wall, and the innermost wall is made to be thinner than the gap.

According to the mode of the invention, the thickness of the innermost wall of the recess portion is made to be thinner than the gap enabling to push the push button, and therefore, the length of the shaft portion of the push button is further shortened and the projected width of the push button projected from the case body outer face in the side direction can be shortened.

According to the invention, by arranging the ring-like packing for sealing the interval between the pipe and the push button within the range of the height of the coil spring for urging the push button and concentrically with the coil spring, the portable apparatus and the portable timepiece capable of shortening the length in the axial direction of the push button can be provided.

DESCRIPTION OF PREFERRED EMBODIMENTS

A first embodiment of the invention will be explained in reference to FIG. 1 and FIG. 2.

Figure 1:
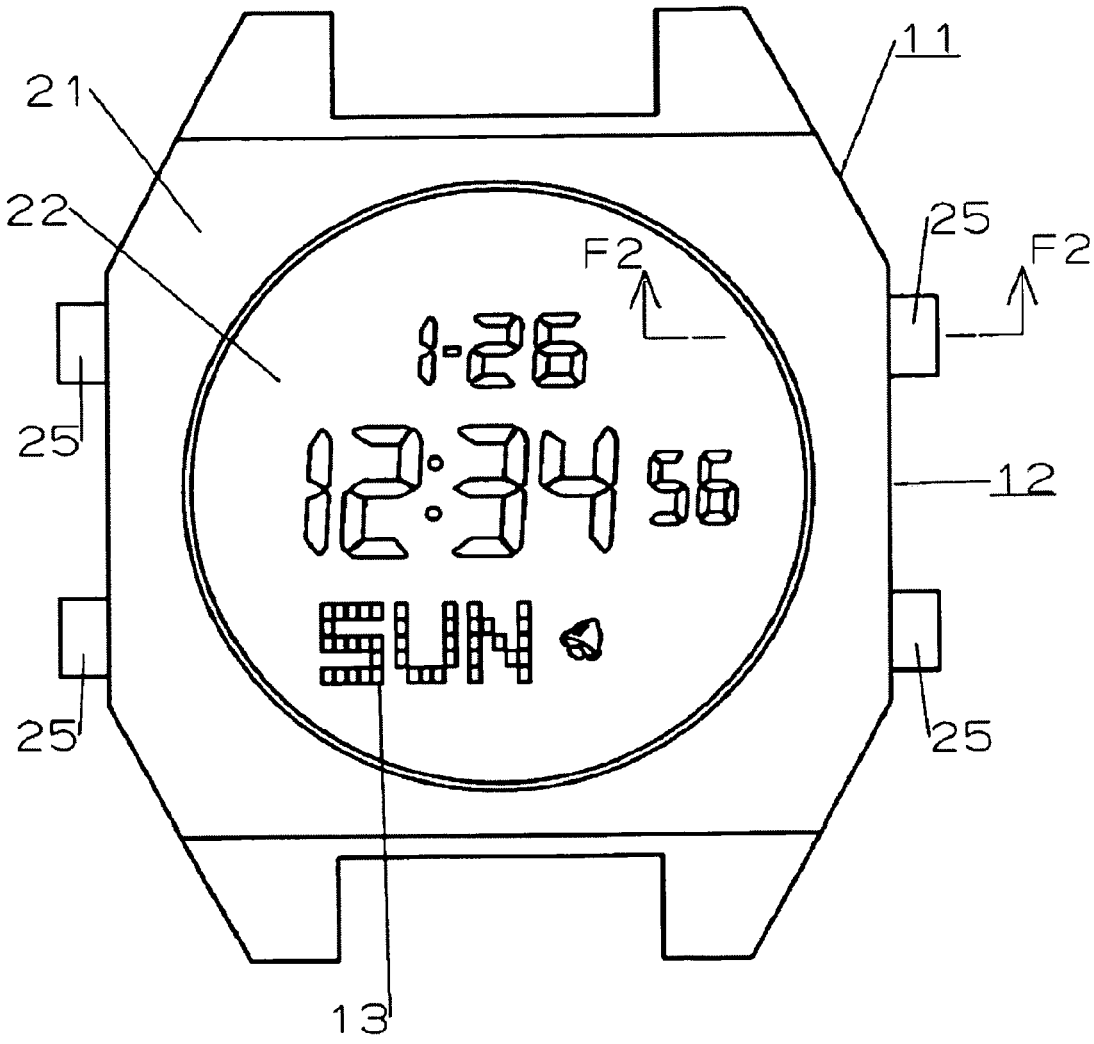
FIG. 1 is a front view showing a wristwatch of a first embodiment of the invention.

In FIG. 1, notation 11 designates a portable apparatus, for example, a portable timepiece, specifically, a wristwatch of a digital display type. The wristwatch 11 includes a timepiece exterior 12 constituting an apparatus exterior. As shown by FIG. 2, necessary members of the wristwatch 11, for example, a liquid crystal display plate 13, a circuit module such as a drive module 14 for controlling a display of a liquid crystal, a lamp (not illustrated), a battery (not illustrated) as a power source, and the like are contained inside of the timepiece exterior 12.

Figure 2:
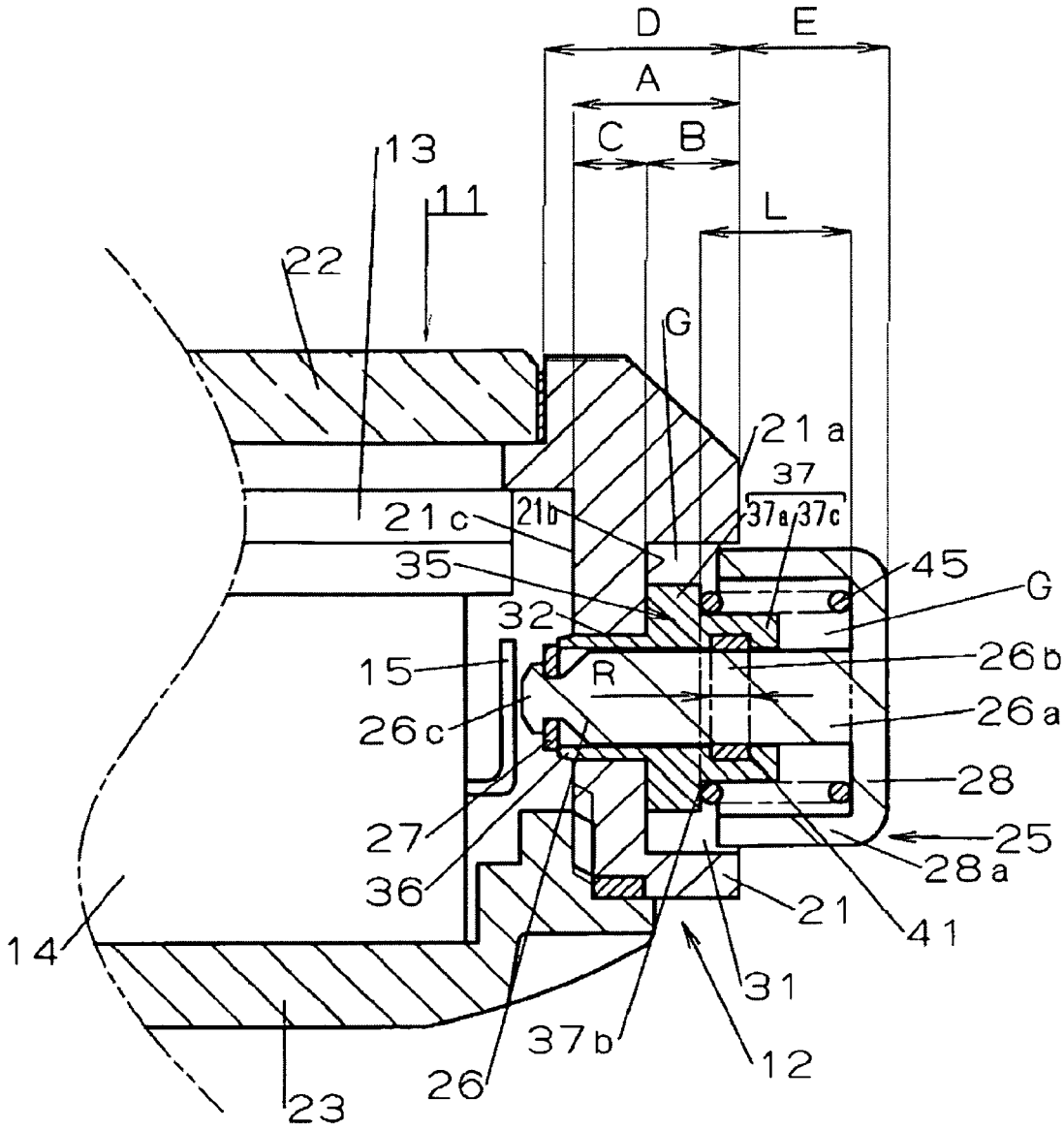
FIG. 2 is a sectional view taken along a line F2-F2 in FIG. 1.

The drive module 14 includes, for example, 4 pieces (only 1 piece is illustrated in FIG. 2) of contacts 15 each comprising a leaf spring or the like, and the contacts 15 are projected from an outer periphery of the drive module 14. By pushing the contacts 15 by a push button mentioned later, functions provided to the respective push buttons are achieved by the drive module 14. For example, a push button 25 at the upper right in FIG. 1 is assigned with a function of start/stop, a push button 25 at the lower right in FIG. 1 is assigned with a function of turning on/turning off a lamp, a push button 25 at the upper left in FIG. 1 is assigned with measurement of lap time, and a push button 25 at the lower left is assigned with a function of switching a display mode of a liquid crystal display plate.

As shown by FIG. 2, the timepiece exterior 12 is formed by mounting cover glass 22 for viewing therethrough the liquid crystal display plate 13 in a liquid tight manner to a front face of a case body 21 made in a ring-like shape by a metal of stainless steel, titanium or the like and mounting a case back 23 made of a metal, a synthetic resin or the like in a liquid tight manner to a back face of the case body 21.

A constitution of mounting push buttons 25 at predetermined portions of the timepiece exterior 12, for example, at four portions of the case body 21 constituting a side wall of the timepiece exterior 12 will be explained. The respective push buttons 25 and constitutions of mounting these to the case body 21 are the same, and therefore, here, a constitution of mounting the push button 25 for start/stop function will representatively be explained in reference to FIG. 2.

The case body 21 is formed with a recess portion 31 opened to a case body outer face (exterior outer side face) 21*a* thereof and formed with a through hole 32 penetrating an innermost wall 21*b* of the recess portion 31. Both of the recess portion 31 and the through hole 32 of a diameter smaller than a diameter of the recess portion 31 are constituted by a circular shape and provided concentric with each other. A thickness A from a case body inner face (exterior inner side face) 21*c* of the case body 21 at which one end of the through hole 32 is opened to the case body outer face 21*a* is set by a total value of a depth B of the recess portion 31 and a thickness C of the innermost wall 21*b*. Further, notation D designates a thickness of a case body front face around the cover glass 22, and the case body front face thickness D is defined by a width dimension reaching the case body outer face 21*a* from a cover glass fitting portion.

A pipe 35 made of a metal of stainless steel, titanium or the like is fixed to the case body 21. The pipe 35 comprises an inserting cylinder portion (inner cylinder portion) 36 and an outwardly arranged cylinder portion (outer cylinder portion) 37 integral therewith. The outwardly arranged cylinder portion 37 is formed by an innermost wall contact portion 37*a* having a spring receiving face 37*b* and a cylinder end portion 37*c* projected in a direction reverse to a direction of projecting the inserting cylinder portion 36 and extending orthogonally from the spring receiving face 37*b*. Although not limited to the following constitution, according to this embodiment, in view of a relationship of making an inner peripheral face of the inserting cylinder portion 36 and an inner peripheral face of the outwardly arranged cylinder portion 37 flush with each other, the innermost wall contact portion 37*a* constitutes a ring-like projected portion projected from an outer periphery of the outwardly arranged cylinder portion 37 and continuous in a peripheral direction.

The pipe 35 is inserted to be attached to the case body 21 by press-fitting and penetrating the inserting cylinder portion 36 through the through hole 32 from an outer side of the case body 21 until the innermost wall contact portion 37*a* is brought into contact with the innermost wall 21*b*. Thereby, the outwardly arranged cylinder portion 37 is disposed at a center portion of the recess portion 31 and arranged at an outer portion of the case body 21.

The cylinder end portion 37*c* of the pipe 35 is attached with a packing 41 in the form of a packing ring for waterproof and dustproof at a ring-like groove formed to be opened at an inner peripheral face thereof. The packing ring 41 is formed in a ring-like shape by a rubber type or plastic type material capable of being deformed elastically.

The push button 25 includes a shaft portion 26, a drawout preventing member 27 and an operating head 28. The shaft portion 26 and the operating head 28 are an integrally molded product of a metal or a synthetic resin and the drawout preventing member 27 is a separate member.

The shaft portion 26 has a shape of a circular pillar and is slidably disposed in the pipe 35. The drawout preventing member 27 comprising a stop member such as a stop ring or the like is attached to one end portion in a longitudinal direction of the shaft portion 26 disposed at an inner portion of the case body 21. The drawout preventing member 27 has a size capable of engaging an end face of the inserting cylinder portion 36 projected to the inner portion of the case body 21 to prevent withdrawal of the shaft portion from the pipe 35.

The operating head 28 is integrally provided to the other end in the longitudinal direction of the shaft portion 26 disposed at an outer portion of the case body 21. The operating head 28 has a cap-like shape and a peripheral wall 28*a* thereof is configured to cover the cylinder end portion 37*c* of the outwardly arranged cylinder portion 37 and fit in the recess portion 31.

The push button 25 is attached to the case body 21 by inserting the shaft portion 26 to the pipe 35 to penetrate from the outer side of the case body 21, thereafter, attaching the drawout preventing member 27 at the front end portion of the shaft portion 26 projected to the inner portion of the case body 21. The packing 41 is brought into close contact with a peripheral face of the shaft portion 26 penetrated to the pipe 35 and an interval of the pipe 35 and the push button 25 is sealed by the packing 41.

The push button 25 is urged in an outer direction of the timepiece exterior 12, specifically, in an outer side direction of the case body 21 by a coil spring 45. For that purpose, the coil spring 45 is interposed between the spring receiving face 37*b* and an inner face of the operating head 28 at one end thereof. The coil spring 45 is brought into a state of being more or less compressed and can further be compressed by pushing the push button 25. The cylinder end portion 37*c* of the outwardly arranged cylinder portion 37 is inserted between a portion of the coil spring 45 on a side of the spring receiving face 37*b* and the shaft portion 26. Thereby, the cylinder end portion 37*c* is opposed to the coil spring 45.

In the wristwatch 11 having the above-described constitution, in an ordinary state in which the push button 25 is not used, such as when carrying the wristwatch 11 or the like, as shown by FIG. 2, the push button 25 is held in an outward position by the urging force of the coil spring 45 in readiness to be pushed inwardly to an inward position to engage the contact 15.

In this state, by the urging force (spring force) of the coil spring 45, the drawout preventing member 27 engages with a front end portion of the inserting cylinder portion 36 and the push button 25 is maintained in its outward position and prevented from being detached. In this state, an opening end portion of the peripheral wall 28*a* of the operating head 28 fits in an opening portion of the recess portion 31, and gaps G enabling to push the push button 25 respectively between the innermost wall 21*b* and the opening end of the peripheral wall 28*a* of the operating head 28 and between the cylinder end portion 37*c* of the outwardly arranged cylinder portion 37 and the inner face of the operating head 28 are ensured. A pushing stroke of the push button 25 is defined by the gaps G. Further, the push button 25 is positioned such that the front end 26*c* of the shaft portion 26 of the push button 25 is proximate to and opposed to the contact 15 of the drive module 14 by engagement of the drawout preventing member 27 with the inserting cylinder portion 36. Further, a foreign matter of water, sand, dust or the like can be restrained from invading the inner portion of the case body 21 by the packing 41 interposed between the pipe 35 and the push button 25.

An operation of pushing the push button 25 is permitted by the gaps G, and therefore, when the push button 25 is pushed from the outer side of the case body 21 against the spring force of the coil spring 45, the front end 26*c* of the shaft portion 26 pushes the contact 15. Thereby, the drive module 14 is operated to achieve the function assigned to the push button 25. Thereafter, as the push button 25 is released from being pushed, the push button 25 is pushed back by the spring force of the coil spring 45.

According to the wristwatch 11 having the above-described constitution, the packing 41 is attached to the cylinder end portion 37*c* of the pipe 35 at a region where the coil spring 45 encircles and overlies the cylinder end portion 37*c*. As illustrated in FIG. 2, when viewed in a direction normal to the axis of the shaft portion 26, the coil spring 45 and the packing ring 41 overlap one another. Therefore, the packing 41 assigned with waterproof or the like is arranged between one end and other end of the coil spring 45, in other words, within a range of a height L of the coil spring 45 and concentrically with the coil spring 45.

According to such an arrangement of the packing 41 and the coil spring 45 around the pushbutton 25, it is not necessary to ensure a region for attaching the packing 41 at the shaft portion 26 of the push button 25 at a position of being shifted from a shaft portion region in correspondence with the height L of the coil spring 45 in an axial direction as in a case of aligning the coil spring 45 and the packing 41 in the axial direction of the shaft portion 26 of the push button 25. In other words, as shown by FIG. 2, a region 26*b* for attaching the packing 41 is provided within a shaft portion region 26*a* in correspondence with the height L of the coil spring 45. Therefore, a length in the axial direction of the push button 25 can be shortened by an amount of a length R in correspondence with a width dimension of the packing 41.

Thereby, under a condition in which the thickness D of the case body front face is made to be the same as that in the background art, a dimension E for projecting the push button 25 from the case body outer face 21*a* can be shortened, conversely, under a condition in which the projected dimension E is made to be the same as that of the background art, the thickness D of the case body front face can be narrowed. Further, in a case of being constituted as in the latter, small-sized and light-weighted formation of the case body 21 can be realized and the wristwatch 11 of a design in which a voluminous feeling of the thickness D of the case body front face is small can be constituted.

Figure 3:
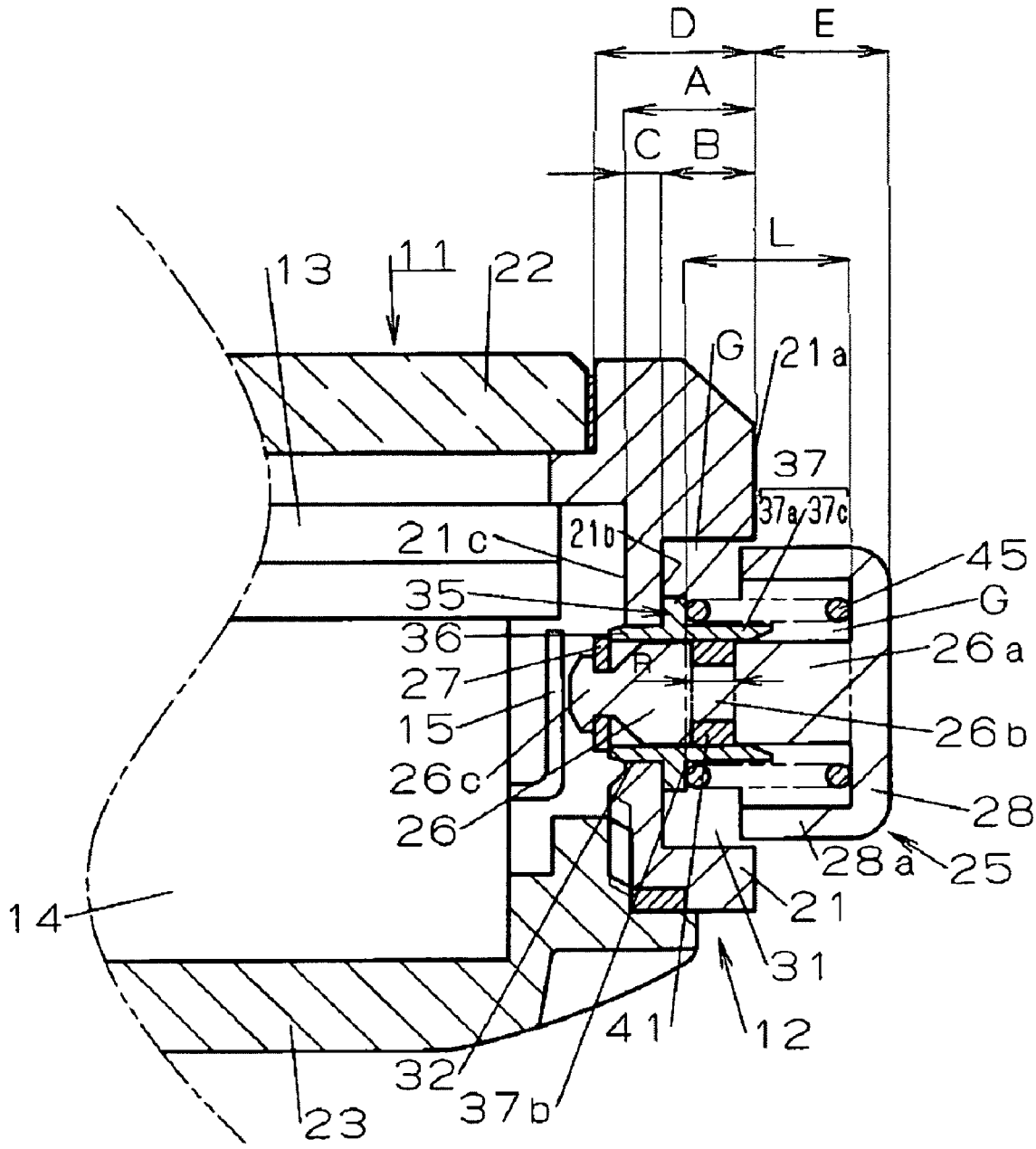
FIG. 3 is a sectional view in correspondence with FIG. 2 showing a wristwatch of a second embodiment of the invention.

FIG. 3 shows a second embodiment of the invention. The second embodiment is the same as the first embodiment except as explained below, and therefore, a description of the elements of the second embodiment that are the same as those of the first embodiment will be omitted.

According to the second embodiment, the packing 41 arranged concentrically with the coil spring 45 is attached to the shaft portion 26. In an ordinary state of pushing back the push button 25 by the coil spring 45, the packing 41 is attached within the shaft portion region 26*a* in correspondence with the height L of the coil spring 45, and the packing 41 is brought into close contact with the inner periphery of the cylinder end portion 37*c* of the pipe 35 inserted between the coil spring 45 and the shaft portion 26. Further, the opening portion of the cylinder end portion 37*c* is provided with a taper face, thereby, insertion of the shaft portion 26 attached with the packing 41 to inside of the pipe 35 is facilitated.

Further, according to the second embodiment, the thickness of the innermost wall 21*b* of the recess portion 31 is made to be thinner than the gap G enabling to push the push button 25, and the thickness of the innermost wall contact portion 37*a* is made to be equal to or thinner than the thickness of the innermost wall 21*b*. The second embodiment is the same as the first embodiment except as explained above.

Therefore, according to the second embodiment, the problem of the invention can be resolved by the reason explained in the first embodiment. In addition thereto, the second embodiment is more excellent than the first embodiment in the following points.

First, since the thickness C of the innermost wall 21*b* of the recess portion 31 is made to be thinner than the gap G enabling to push the push button 25, and therefore, the length of the shaft portion 26 of the push button 25 can be made to be shorter than that of the push button used in the first embodiment in accordance therewith. Further, also the thickness of the innermost wall contact portion 37*a* is made to be thin, and therefore, the length of the shaft portion 26 can further be shortened also in this respect, and the projected width of the push button 25 projected from the case body outer face 21*a* to the outer side direction can be shortened in accordance therewith.

Therefore, under a condition in which the size of the gap G is made to be the same as the gap according to the first embodiment, the case body front face thickness D reaching the case body outer face 21*a* from the cover glass fitting portion of the case body 21 can be narrowed. Thereby, in comparison with the first embodiment, further small-sized and light-weighted formation of the case body 21 can be realized, and the wristwatch 11 of a design in which the volume feeling of the case body front face thickness D is further small can be constituted.

Second, by attaching the packing 41 to the shaft portion 26, a wall thickness for holding the packing 41 is not needed in the outwardly arranged cylinder portion 37 of the pipe 35. In accordance with thinning the wall thickness of the outwardly arranged cylinder portion 37 in this way, a maximum diameter of the outwardly arranged cylinder portion 37 defined by the innermost wall contact portion 37*a* can be reduced. Therefore, despite that the diameter of the shaft portion 26 is the same as that in the case of the first embodiment, the small diameter coil spring 45 can be used and the operating head 28 of the push button 25 can be formed by a small diameter in accordance therewith.

Further, in a case of achieving small-diameter formation of the push button 25 in this way, also the diameter of the formed recess portion 31 of the case body 21 is reduced, and therefore, the thickness (height) of the total of the case body 21 is made to be smaller than that of the first embodiment and thin-sized formation of the wristwatch 11 can be achieved.

Further, although according to the above-described respective embodiments, waterproof is achieved between the pipe 35 and the shaft portion 26 of the push button 25, in place thereof, waterproof can also be achieved between the pipe 35 and the operating head 28 of the push button 25. In this case, the cylinder end portion 37*c* of the outwardly arranged cylinder portion 37 of the pipe 35 may be inserted between the outer periphery of the portion of the coil spring 45 on the side of the spring receiving face 37*b* and the peripheral wall 28*a* of the operating head 28 and the packing 41 brought into close contact with the inner face of the peripheral wall 28*a* may be attached to the cylinder end portion 37*c* at the outer peripheral portion of the cylinder end portion 37*c*. Although according to the constitution, the packing 41 of the diameter larger than those of the respective embodiments needs to be used, the constitution is preferable in that waterproof/dustproof can be carried out for the coil spring 45.

The invention is not restricted to the respective embodiments but is applicable to a stopwatch, a portable apparatus of, for example, a portable telephone, a portable type information terminal or the like other than the portable timepiece.

What is claimed is:

1. A portable apparatus comprising:

an apparatus exterior having a through hole;

a pipe having an outwardly arranged cylinder portion having a spring receiving face, and an inserting cylinder portion integral with the outwardly arranged cylinder portion, the inserting cylinder portion being inserted in the through hole and fixed to the apparatus exterior with the outwardly arranged cylinder portion disposed at an outer portion of the apparatus exterior;

a push button including a shaft portion axially slidable in the pipe, a drawout preventing member attached to one end portion of the shaft portion inside the apparatus exterior for preventing the shaft portion from being drawn out from the pipe, and an operating head provided at the other end of the shaft portion outside of the apparatus exterior;

a coil spring interposed between the operating head and the spring receiving face for urging the push button toward an outer side of the apparatus exterior; and a packing ring attached to either of the pipe and the push button within a range of a height of the coil spring for sealing an interval between the pipe and the push button.

2. A portable apparatus according to claim 1; wherein the outwardly arranged cylinder portion includes a cylinder end portion extending from the spring receiving face toward the outer side of the apparatus exterior and opposed to a portion of the coil spring on a side of the spring receiving face, and the packing is attached to the cylinder end portion.

3. A portable apparatus according to claim 1; wherein the outwardly arranged cylinder portion includes a cylinder end portion extending from the spring receiving face toward the outer side of the apparatus exterior and inserted between the coil spring and the shaft portion, and the packing is attached to the shaft portion and contacts an inner periphery of the cylinder end portion.

4. A portable apparatus according to claim 1; wherein the portable apparatus is a portable timepiece.

5. A portable timepiece comprising:

a timepiece exterior assembly including a case body having a recess portion opened to a case body outer face and provided with a through hole at an innermost wall of the recess portion;

a pipe having an outwardly arranged cylinder portion having a spring receiving face, and an inserting cylinder portion integral with the outwardly arranged cylinder portion, the inserting cylinder portion being inserted in the through hole and fixed to the case body with the outwardly arranged cylinder portion disposed in the recess portion of the case body;

a push button having a shaft portion axially slidable in the pipe, a drawout preventing member attached to one end portion of the shaft portion inside the case body for preventing the shaft portion from being drawn out from the pipe, and an operating head provided at the other end of the shaft portion outside of the case body;

a coil spring interposed between the operating head and the spring receiving face for urging the push button toward an outer side of the case body and forming a gap between the innermost wall and the operating head to enable the push button to be pushed inwardly against the urging of the coil spring; and a packing ring attached to either of the pipe and the push button within a range of a height of the coil spring for sealing an interval between the pipe and the push button.

6. A portable timepiece according to claim 5; wherein a thickness of the case body from an inner face to the outer face thereof is equal to a depth of the recess portion and a thickness of the innermost wall, and the innermost wall is thinner than the gap.

7. A portable appratus comprising:

a casing having a through-hole that extends from an outer face of the casing to an inner face thereof;

a pipe having an inner cylinder portion inserted into the through-hole and fixed to the casing, and an outer cylinder portion integral with the inner cylinder portion and extending outside the casing;

a push button having a shaft portion and a head portion, the shaft portion being axially slidable in the pipe and slidably contacting the outer cylinder portion throughout the length of the outer cylinder portion, and the shaft portion having an inner end that extends inside the casing and an outer end that extends outside the casing and is connected to the head portion;

a coil spring encircling the outer cylinder portion of the pipe and interposed between the head portion and a spring receiving face of the outer cylinder portion for urging the push button outwardly to an outward position and enabling the push button to be pushed inwardly against the urging of the coil spring to an inward position; and a packing ring attached to either the outer cylinder portion of the pipe or the shaft portion of the push button in the region where the coil spring encircles the outer cylinder portion to seal a space between the pipe and the push button.

8. A portable apparatus according to claim 7; wherein the coil spring and the packing ring overlap one another when viewed in a direction normal to the axis of the shaft portion.

9. A portable apparatus according to claim 7; wherein the packing ring is attached to the outer cylinder portion and slidably contacts an outer periphery of the shaft portion.

10. A portable apparatus according to claim 9; wherein the packing ring is disposed in an annular groove in the outer cylinder portion.

11. A portable apparatus according to claim 7; wherein the packing ring is attached to the shaft portion and slidably contacts an inner periphery of the outer cylinder portion.

12. A portable apparatus according to claim 11; wherein the packing ring is disposed in an annular groove in the shaft portion.

13. A portable apparatus according to claim 7; wherein the push button includes a stop member connected to an inner end portion of the shaft portion and engageable with an inner end of the inner cylinder portion of the pipe to prevent withdrawal of the shaft portion from the pipe.

14. A portable apparatus according to claim 7; further including a circuit module disposed inside the casing, the circuit module having a movable contact in opposed, spaced relation from the inner end of the shaft portion, whereby pushing of the push button to the inward position moves the contact to switch a function of the circuit module.

15. A portable apparatus according to claim 7; wherein the outer face of the casing has a recess portion, the through-hole extends from a bottom of the recess portion to the inner face, and the push button moves into the recess portion when pushed to the inward position.

16. A portable apparatus according to claim 15; wherein the packing ring is attached to the shaft portion of the push button and is disposed entirely within the recess portion when the push button is in the outward position.

17. A portable apparatus according to claim 15; wherein the packing ring is attached to the outer cylinder portion of the pipe and is disposed partly within the recess portion when the push button is in the outward position.

18. A portable apparatus according to claim 7; wherein the portable apparatus is a timepiece.

19. A portable apparatus according to claim 18; wherein the packing ring is attached to the outer cylinder portion and slidably contacts an outer periphery of the shaft portion.

20. A portable apparatus according to claim 18; wherein the packing ring is attached to the shaft portion and slidably contacts an inner periphery of the outer cylinder portion.

* * * * *